US006203361B1

(12) United States Patent
McGaffin

(10) Patent No.: US 6,203,361 B1
(45) Date of Patent: Mar. 20, 2001

(54) STRAIN RELIEF SYSTEM AND METHOD FOR SECURING CABLES TO A CARRIER

(76) Inventor: David G. McGaffin, 11711 Bush La., Forney, TX (US) 75126

( * ) Notice: Subject to any disclaimer, the term of this patent is extended or adjusted under 35 U.S.C. 154(b) by 0 days.

(21) Appl. No.: 09/325,686

(22) Filed: Jun. 3, 1999

(51) Int. Cl.[7] ..... H01R 13/58
(52) U.S. Cl. ..... 439/451; 439/465
(58) Field of Search ..... 439/451, 465, 439/467, 456, 459, 471, 464, 499, 498

(56) References Cited

U.S. PATENT DOCUMENTS 5,195,909 * 3/1993 Huss ..... 439/465

* cited by examiner

*Primary Examiner*—Renee Luebke
*Assistant Examiner*—Phuong Chi Nguyen
(74) *Attorney, Agent, or Firm*—Gray Cary Ware and Freidenrich

(57) ABSTRACT

An apparatus used to secure a carrier to one or more communication cables coupled to the carrier. The strain relief system and method for securing the cable(s) to the carrier includes a clamping fixture surrounding the interface between the carrier and the cable(s) and a tether comprising a first and second end. The first end of the tether is coupled to the clamping fixture while the second end of the tether is coupled to the source of the cable(s).

23 Claims, 3 Drawing Sheets

STRAIN RELIEF SYSTEM AND METHOD FOR SECURING CABLES TO A CARRIER

TECHNICAL FIELD OF THE INVENTION

The present invention relates generally to systems and methods for connecting cables to connector carriers, and more particularly to a system and method for securing cables to a carrier that relieves strain on the cables and prevents inadvertent damage or disconnection of the cables from the carrier.

BACKGROUND OF THE INVENTION

In recent years, the increase in the usage of electrical equipment such as audio visual equipment, electronics, power supplies, and computers has increased the number of cables and connectors used to interconnect such equipment. Often these cables are large and bulky, imparting strain on the cables and the connector. Alternatively, the cables and connectors may be small, delicate, and easily susceptible to damage from small forces. In either case, the connectors and cables can be fairly expensive. Damage to either may result in monetary losses, disruption to electronic systems, and electrical hazards.

Various methods and systems have been proposed to securely fasten cables to an interface. One method is disclosed in U.S. Pat. No. 4,842,550 issued Jun. 27, 1989, to Fry, et al. Fry, et al. discloses a molded housing with a cover in a base. A tie strap connected to the base ties around the cables and is used as a strain relief.

Another method to securely fasten cables to an interface is disclosed in U.S. Pat. No. 4,842,549, issued Jun. 27, 1989, to Asick, et al. Asick, et al., discloses a two-piece housing, dual-diameter strain relief, and a dual-diameter cylindrical channel. Forces on the cables are transferred to the housing through a cable tie that wraps once around the cable and rests in a recess in the bottom housing piece. The cylindrical channel in which the cable resides has a smaller diameter portion and a larger diameter portion. Smaller diameter cables are strain relieved in the smaller portion of the channel, whereas larger diameter cables on strain relieved in the larger portion of the channel.

A third system for securely fastening cables to a connector is disclosed in U.S. Pat. No. 4,640,984, issued Feb. 3, 1987, to J. W. Kalbfeld. Kalbfeld discloses a strain relief made of resiliently deformable material consisting of two portions coupled by a strap, the portions surrounding the cable in such a manner to force the cables into a U-shaped bend. The friction of the bend prevents the movement of the cables relative to the strain relief. At least one of the two portions has a means to attach to a two-part connector with a lower and upper body. The lower body can be securely coupled to each other through the use of connectors such as screws.

Each of these prior art patents have strain relief mechanisms that physically contact the cables that are being coupled to the connector. These configurations may subject the cables to physical deformation and strain over time. Physical damage may result in an electrical failure. Also, each of these prior art patents discloses fairly complex molded housings that surround the interface connector. These housings may not be readily adapted to varying sizes of cables and connectors.

Moreover, a need exists for an apparatus that will protect the interface between cables and a connector that is readily adaptable to various interface and cable sizes. Also, it would be advantageous if the strain relief for the interface connector does not present any physical strain on the cable itself.

SUMMARY OF THE INVENTION

The present invention provides a system and method for securing cables to a connector carrier that substantially eliminates or reduces disadvantages or problems associated with previously developed systems and methods used for securing cables to a connector carrier.

More specifically, the present invention provides an apparatus used to secure a carrier to one or more cables coupled to the carrier. The strain relief system and method for securing the cable(s) to the carrier includes a clamping fixture surrounding the interface between the carrier and the cable(s) and a tether comprising a first and second end. The first end of the tether is coupled to the clamping fixture while the second end of the tether is coupled to the source of the cable(s).

The present invention provides an important technical advantage by implementing a simple design easily adaptable to various interface connection sizes. The dual-plated clamping fixture is easily modified to interface with various types of connectors.

The present invention provides another technical advantage by implementing a tether that reduces strain on the cables connected to the interface. The tether, however, does not contact the cable(s) and therefore does not impart physical damage upon the cable(s). Any physical strain placed on the cable(s) is transferred from the termination of the cable(s) to the dual-plated clamping fixture. Also, the length of the tether is shorter than the length of the cable(s). Thus, this prevents the source of the cable(s) from being pulled from the termination of the cable(s) any distance farther than the length of the tether.

BRIEF DESCRIPTION OF THE DRAWINGS

A more complete understanding of the present invention and the advantages thereof may be acquired by referring to the following description, taken in conjunction with the accompanying drawings in which like reference numbers indicate like features and wherein.

DETAILED DESCRIPTION OF THE INVENTION

Preferred embodiments of the present invention are illustrated in the figures, like numerals being used to refer to like and corresponding parts of various drawings.

The present invention provides a system for securing a connector to one or more cables. The system includes a clamping fixture that surrounds and reinforces the carrier and the cables. The system also includes a tether to reduce the strain on the cables as well as prevent inadvertent disconnection of the cables from the connector.

The present invention provides a system and method for securing cables to a carrier that relieves strain on the cables and prevents inadvertent damage or disconnection of the cables from the carrier.

The method of the present invention provides for securing an interface connection. The interface connection may consist of one or more cables coupled to a carrier. A clamping fixture secures the cables to the carrier and prevents any relative motion between the cables. The clamping fixture may have a variety of internal surfaces which interlock with surfaces of the connector to prevent relative motion. Stress is relieved within the cables by coupling a stess relieving tether to the clamping fixture. This tether serves to accept stresses which would other wise be imparted on the cable by providing that the there is an excess in the length of the cables as compared to the length of the tether. Additionally, the stress on the cable and its terminal connections by which it is coupled to the carrier may be reduced by having the terminal connections abut the clamping fixture. This will further restrict the movement of the cables relative to the carrier.

Figure 1:
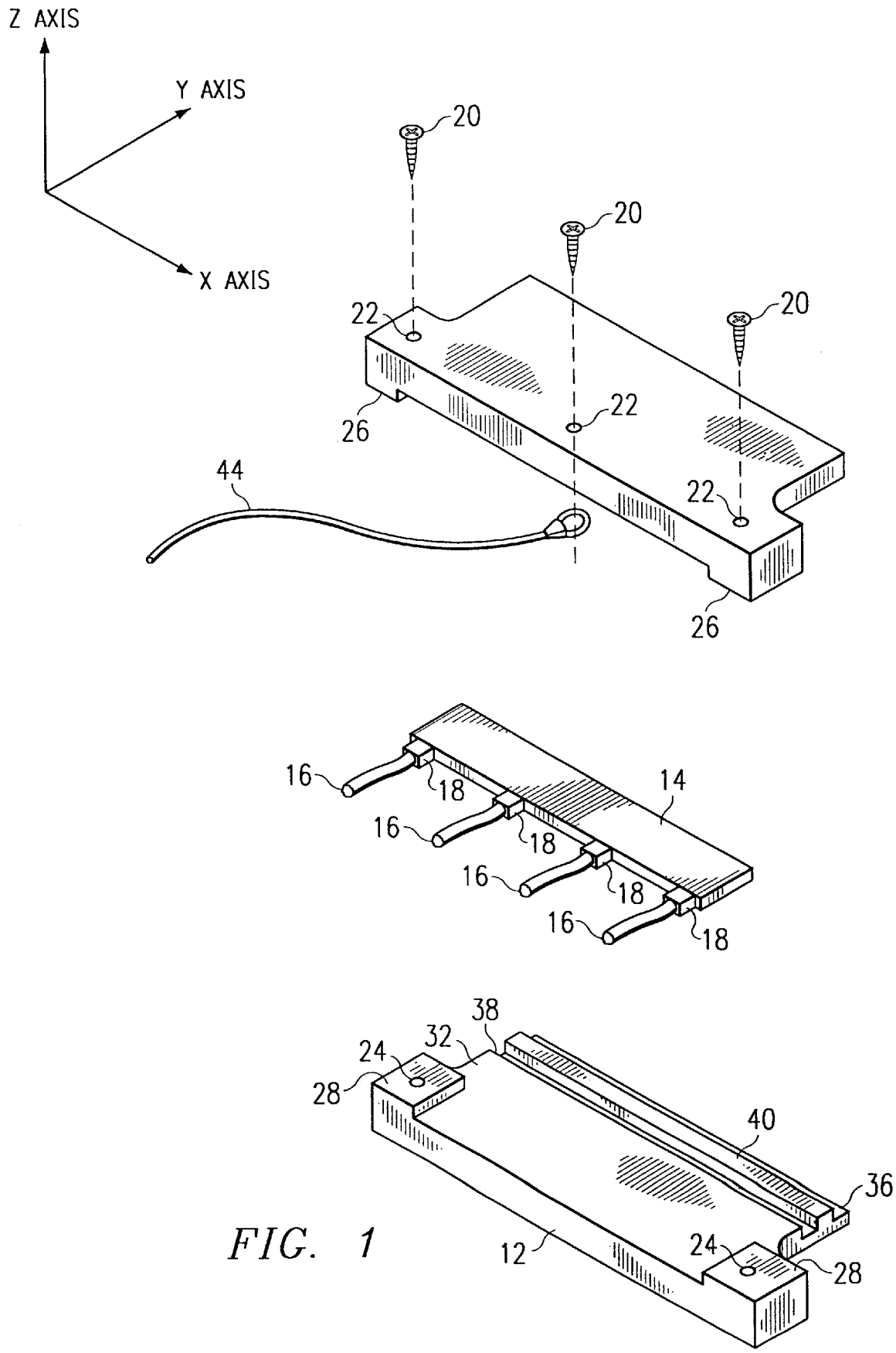
FIG. 1 is an exploded perspective of the assembly of an embodiment of the present invention.

FIG. 1 is an exploded perspective of one embodiment of the present invention. This embodiment consists of a top plate 10 placed in parallel with a base plate 12 to form a clamping fixture that surrounds the carrier 14 which connects to one or more cables 16. The cables 16 are coupled to the carrier 14 at the cable terminations 18. A group of screws 20 may pass through holes 22 in the top plate 10 and subsequently thread into threaded holes 24 in the base plate 12 to securely fasten the top plate 10 to the base plate 12. Two protruding flat surfaces 26 on the bottom face of the top plate 10 fit flatly against two corresponding flat protruding surfaces 28 on the top face of the base plate 12. Two flat recessed surface 30, 32 reside between the two flat protruding surfaces 26, 28 on both the bottom of the top plate 10 and the top of the base plate 10 respectively. Due to the perspective of FIG. 1, the first flat recessed surface 30 on the bottom surface of the top plate 12 can not be seen. These two first recessed surfaces 30,32 form a cavity for the one or more cables 16 attached to the carrier 14. The cavity prevents movement of the connector in the z-direction. Both the two first recessed surfaces 30,32 are further recessed to form two second recessed surfaces 34,36. The second recessed surface 34 of the top plate cannot be seen in FIG. 1 but is shown in FIG. 4A. When the clamping fixture is secured properly, the second recessed surface 34 on the bottom face of the top plate 10 and the second recessed surface 36 on the top face of the bottom plate 12 fit tightly against the top and bottom face of the carrier 14 respectively. Edges 38 between the first recessed surfaces 30,32 and the second recessed surfaces 34,36 on both the top plate 10 and the base plate 12 abut the top and bottom of the cable terminations 18. The edge 38 on the bottom face of the top plate 10 can not be seen in FIG. 1. The second recessed surface 36 on the base plate 12 has a rectangular ridge 40 that engages a rectangular groove 42 in the carrier 14. Due to the perspective of FIG. 1 the rectangular groove 42 cannot be seen on the bottom face of the carrier 14. A tether 44 can be attached between the top plate 10 and the carrier 14 by means of a screw 20. Attaching the tether 44 is illustrated more clearly in FIG. 3B.

Figure 2:
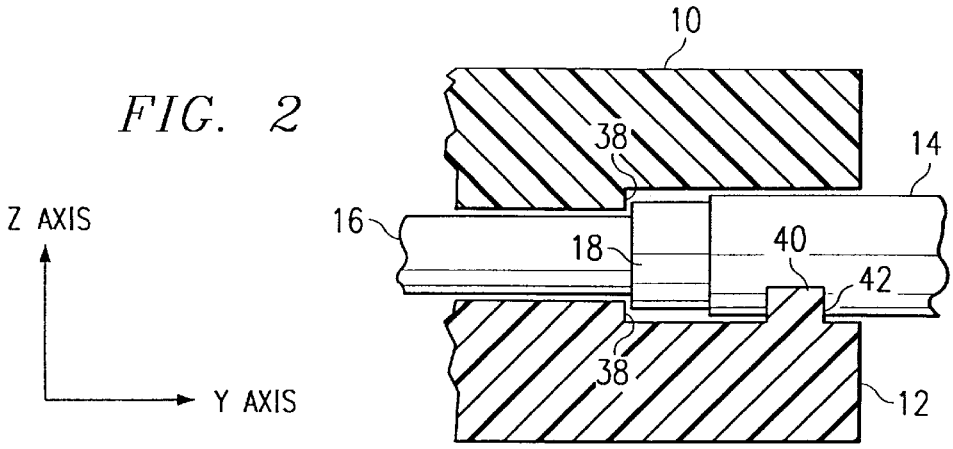
FIG. 2 is a side view of the coupling of the carrier by the clamping fixture.

FIG. 2 represents a side view of the coupling of the clamping fixture comprising the top plate 10 and bottom plate 12 and the carrier 14. From the side view it can be seen how the ridge 40 on the top face of the base plate 12 prevents movement of the carrier 14 by engaging the groove 42 on the bottom face of the carrier 14. It can also be seen from FIG. 2 that cable terminations 18 abut against both the edge 38 between the two recessed surfaces 30,34 on the bottom face of the top plate 10 and the edge 38 between the two recessed surfaces 32,36 on the top face of the base plate 12. This abutment prevents movement of the cable terminations 18 relative to the clamping fixture.

Figure 3A:
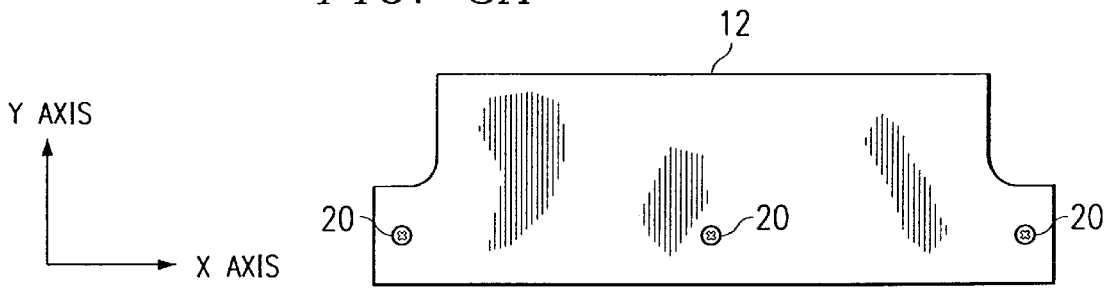
FIGS. 3A and 3B illustrate a top view and front view of the clamping fixture with the tether.
Figure 3B:
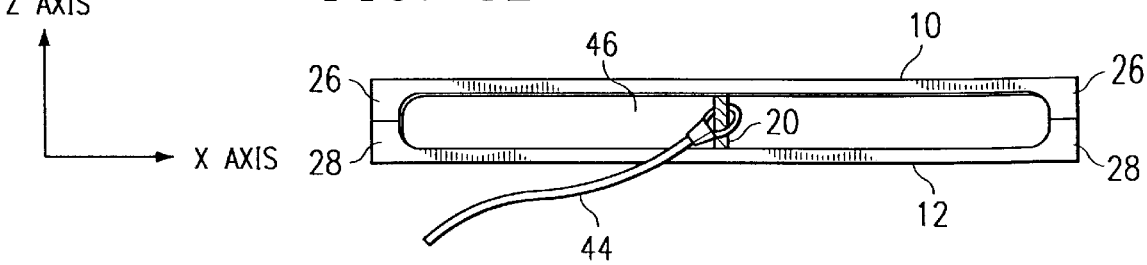
Figure 4A:
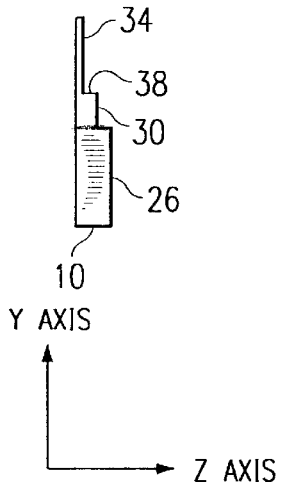
FIGS. 4A and 4B illustrate the side view and bottom view of the top plate of the clamping fixture and FIGS. 5A and 5B illustrate the top view and side view of an additional embodiment of the base plate of the clamping fixture.

FIGS. 3A and 3B illustrate the top view and front view of the clamping fixture and the tether 44. The carrier 14 and the one or more cables 16 have been omitted for simplicity. It can be seen in FIG. 3B that the tether 44 surrounds a screw 20 that couples the top plate 10 and base plate 12 securely together. It can also be seen in FIG. 3B that the raised edges 26,28 on the bottom corners of both top plate 10 and base plate 12 abut together to leave a cavity 46 between the top plate 10 and the base plate 12 of the clamping fixture. The cavity 46 allows room for the one or more cables 16 that connect to the carrier 14. The cavity 46 does not impart any physical stress on the cable 16.

Figure 4B:
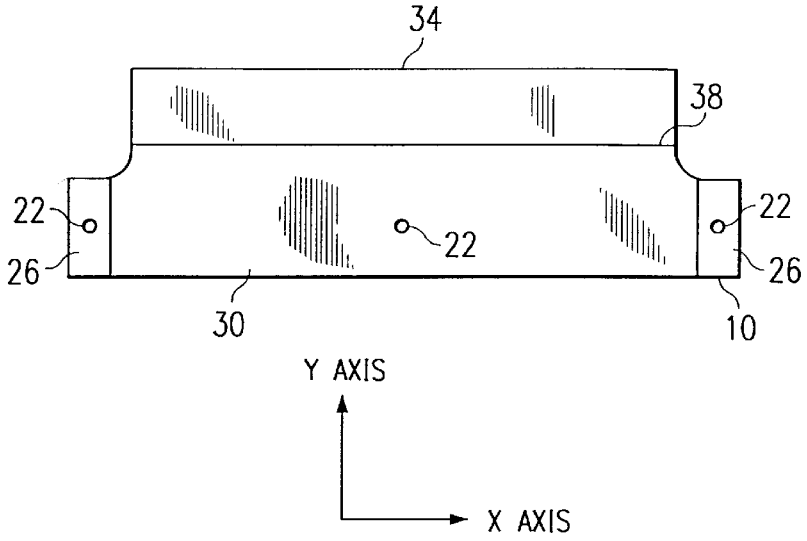

FIGS. 4A and 4B provide additional views of the top plate 10. FIG. 4A provides the side view of the top plate 10 including the flat protruding surface 26, the first recessed surface 30, the second recessed surface 34, and the edge 38 between the first recessed surface 30 and the second recessed surface 34. FIG. 4B provides a view of the bottom surface of the top plate 12 including the flat protruding surfaces 26, the first recessed surface 30, the second recessed surface 34, the edge 38 between the first recessed surface 30 and the second recessed surface 34, and the holes 22 for the screws 20 to fasten the top plate 10 to the base plate 12.

Figure 5A:
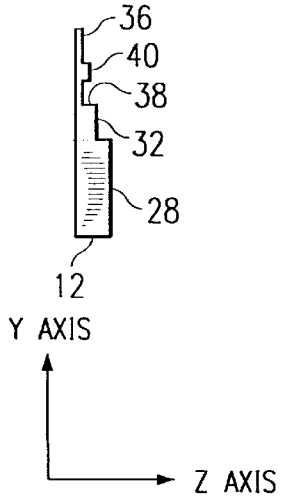
Figure 5B:
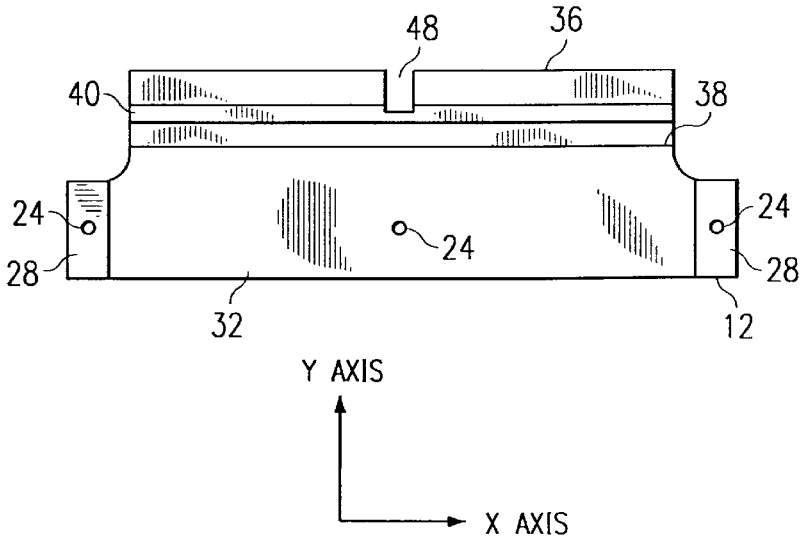

FIGS. 5A and 5B provide views of an additional embodiment of the base plate 12. FIG. 5A provides the side view of the base plate 12 including the flat protruding surface 28, the first recessed surface 32, the second recessed surface 36, the edge 38 between the first recessed surface 32 and the second recessed surface 36, and the rectangular ridge 40 that engages the carrier 14. FIG. 5B provides a view of the top surface of the base plate 12, including the flat protruding surface 28, the first recessed surface 32, the second recessed surface 36, the edge 38 between the first recessed surface 32 and the second recessed surface 36, the rectangular ridge 40 that engages the carrier 14, and the threaded screw holes 24 for the screws 20 to fasten the top plate 10 to the base plate 12.

In addition, this embodiment of the base plate 12 may include a notch 48 that can transverse the second recessed surface 36 of the base plate 12 in the y-direction and may partially transverse the ridge 40 of the base plate 12. This notch conforms to a corresponding structure on the carrier and serves to properly position the base plate 12 and corresponding top plate 10 relative to the carrier as well as prevent movement of the base plate in the y-direction relative to the carrier.

The present invention provides an important advantage in that the dual-plated structure consisting of a top plate 10 and a base plate 12 reinforces the connection between the cables 16 and the carrier 14. The dual-plated clamping fixture protects the interface between the carrier 14 and the cables 16 from external forces that may cause inadvertent disconnection of the cables 16 from the carrier 14.

Another technical advantage of the present invention is that the base plate 12 consists of a ridge 40 that mates with a corresponding groove 42 in the carrier 14. This ridge prevents movement of the carrier 14 in the y-direction with reference to the clamping fixture.

The present invention provides still another technical advantage in that a groove 48 on the base plate 12 further aids in placement of the clamping fixture with reference to the carrier 14. The groove also prohibits movement of the carrier 14 in the y-director relative to the clamping fixture.

Another technical advantage of the present invention is that the edge 38 between the first recessed surfaces 30, 32 and the second recessed surfaces 34, 36 abut the terminations 18 of the cables 16. This prevents the movement of the cables 16 away from the carrier 14. Also any forces felt on the cables 16 are transferred to the clamping fixture through the terminations.

The present invention provides yet another technical invention in that the tether 44 provides a strain relief for the cables 16. The tether 44 prevents the source of the cables from being pulled away from the terminations 18 of the cables any distance further than the length of the cables 16. Since the tether 44 is shorter than the cables 16, this eliminates or reduces strain on the cables 16 and transfers it to the clamping fixture.

Although the present invention has been described in detail herein with reference to the illustrative embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the spirit and true scope of this invention as claimed below.

What is claimed is:

1. A method for securing a data connection comprising the steps of:

coupling at least one data cable having a cable terminator to a carrier; and restraining relative motion between said cable terminator and said carrier with a clamping fixture, wherein the clamping fixture is a dual-plated unit further comprising a base plate and a top plate placed in parallel and secured together by fasteners, and wherein said top plate further comprises:

two flat raised surfaces on bottom comers of a bottom face of said top plate;

a first recessed surface between said two flat raised surfaces on said top plate;

a second recessed surface adjacent to and more recessed than said first recessed surface on said top plate;

a step between said first recessed surface and said second recessed surface of said top plate; and a top face with no recessed surface.

2. The method of claim 1, wherein at least one of said base plate or said top plate engages said carrier to prevent movement of said carrier with reference to said clamping fixture.

3. The method of claim 1, wherein said cable terminator abuts an orthogonal internal surface within said clamping fixture to prevent movement of cables relative to damping fixture and carrier.

4. The method of claim 1, further comprising the step of tethering said clamping fixture to prevent stresses within said at least one data cable with a tether.

5. The method of claim 4, wherein a source end of said tether is coupled to a source of said at least one data cables to relieve tension on said at least one data cables, and wherein said tether is shorter than said at least one data cables.

6. The method of claim 1, wherein said base plate further comprises:

two flat raised surfaces on bottom corners of a top face of said base plate;

a first recessed surface between said two flat raised surfaces on said base plate;

a second recessed surface adjacent to and more recessed than said first recessed surface on said base plate;

a step between said first recessed surface and said second recessed surface of said base plate; and a bottom face with no recessed surface.

7. The method of claim 6, wherein said two flat surfaces of said top plate fit flush against said two flat raised surfaces of said base plate, said first recessed surface of said top plate and said first recessed surface of said base plate forming a first cavity for said one of more communication cables, said second recessed surface of said top plate and said second recessed surface of said base plate for a second cavity for carrier.

8. The method of claim 7, wherein said second recessed surface of said base plate further comprises a protruding ridge that mates with a corresponding groove on said carrier to prevent movement of said carrier with respect to said carrier.

9. The method of claim 8, wherein said termination end of said tether is fixed to one of said fasteners.

10. The method of claim 9, wherein said base plate further comprises a notch transversing said base plate and conforming to mating structure on carrier to further stabilize said carrier between said clamping fixture and properly position said base plate and corresponding top plate relative to said carrier.

11. The method of claim 10, wherein said source end of said tether is coupled to a source of said at least one cables to relieve tension on said at least one cables, said tether is shorter than said at least one cables.

12. An apparatus to secure a data connection, comprising:

at least one data cable, wherein said at least one data cable ends in a cable terminator, a carrier that receives said cable terminators of said at least one data cable;

a clamping fixture, which comprises a base plate and a top plate placed in parallel, to secure said cable terminator to said carrier; and a plurality of internal surfaces within said clamping fixture that interlock with said cable terminators and said carrier to prevent relative motion between said cable terminators, said carrier and said damping fixture, and wherein said plurality of internal surfaces further comprise:

two flat raised surfaces on bottom comers of a bottom face of said top plate;

a first recessed surface between said two flat raised surfaces on said top plate;

a second recessed surface adjacent to and more recessed than said first recessed surface on said top plate;

a step between said first recessed surface and said second recessed surface of said top plate; and a top face with no recessed surface.

13. The apparatus of claim 12, further comprising a tether having a source end and termination end, said source end coupled to said clamping fixture.

14. The apparatus of claim 12, wherein the base plate and the top plate are secured together by fasteners.

15. The apparatus of claim 12, wherein at least one of said base plate or said top plate engages said carrier to prevent movement of said carrier relative to said clamping fixture.

16. The apparatus of claim 12, wherein said cable terminator couples the cable to the carrier, said cable terminal abuts an orthogonal internal surface within the clamping fixture to prevent movement of cables relative to said damping fixture and said carrier.

17. The apparatus of claim 12, wherein said source end of said tether is coupled to a source of said at least one cables to relieve tension on said at least one cables, said tether is shorter than said at least one cables.

18. The apparatus of claim 12, wherein said base plurality of internal surfaces further comprise:

two flat raised surfaces on top corners of a top face of said base plate;

a first recessed surface between said two flat raised surfaces on said base plate;

a second recessed surface adjacent to and more recessed than said first recessed surface on said base plate;

a step between said first recessed surface and said second recessed surface of said base plate; and a bottom face with no recessed surface.

19. The apparatus of claim 18, wherein said two flat surfaces of said top plate fit flush against said two flat raised surfaces of said base plate, said first recessed surface of said top plate and said first recessed surface of said base late forming a first cavity for said at least one data cables, said second recessed surface of said top plate and said second recessed surface of said base plate for a second cavity for carrier.

20. The apparatus of claim 19, wherein said second recessed surface of said base plate further comprises a protruding ridge that mates with a corresponding groove on said carrier to prevent movement of said carrier with respect to said carrier.

21. The apparatus of claim 20, wherein said termination end of said tether is fixed to one of said fasteners.

22. The apparatus of claim 21, wherein said base plate further comprises a notch transversing said base plate and conforming to mating structure on carrier to further stabilize said carrier between said damping fire and properly position said base plate and corresponding top plate relative to said carrier.

23. The apparatus of claim 22, wherein said source end of said tether is coupled to a source of said at least one cables to relieve tension on said at least one cables, said tether is shorter than said at least one cables.

* * * * *